US007581619B1

(12) United States Patent
Storm

(10) Patent No.: US 7,581,619 B1
(45) Date of Patent: Sep. 1, 2009

(54) MOVABLE BAFFLE COLUMNS FOR USE WITH AIR HANDLING UNITS

(75) Inventor: Mark Storm, San Diego, CA (US)

(73) Assignee: Energy Labs, Inc., San Diego, CA (US)

( * ) Notice: Subject to any disclaimer, the term of this patent is extended or adjusted under 35 U.S.C. 154(b) by 0 days.

(21) Appl. No.: 11/823,664

(22) Filed: Jun. 28, 2007

(51) Int. Cl.
*E04F 17/04* (2006.01)

(52) U.S. Cl. ..... 181/225; 181/224; 181/271; 181/277; 181/287; 138/39; 454/262; 454/346; 454/906

(58) Field of Classification Search ..... 181/224, 181/225, 287, 226, 241, 243, 271, 277; 138/39; 454/262, 346, 906; 55/328, 422
See application file for complete search history.

(56) References Cited

U.S. PATENT DOCUMENTS 3,219,143 A 11/1965 Bohanon
3,452,667 A 7/1969 Coleman et al.
3,507,356 A 4/1970 Smith
3,592,123 A 7/1971 Henken et al.
3,929,285 A 12/1975 Daugherty, Jr.
3,985,198 A 10/1976 Kurtze et al.
4,164,265 A 8/1979 Kucharczyk
4,276,954 A * 7/1981 Romano ..... 181/224
4,580,654 A 4/1986 Hale
4,660,676 A 4/1987 Eustace
5,879,031 A 3/1999 Bryant et al.
6,145,616 A 11/2000 Ewanek
6,263,998 B1 7/2001 Schockemoehl et al.
2006/0144638 A1 * 7/2006 Radatus et al. ..... 181/224

* cited by examiner

*Primary Examiner*—Jeffrey Donels
*Assistant Examiner*—Jeremy Luks
(74) *Attorney, Agent, or Firm*—Rod D. Baker

(57) ABSTRACT

A sound-baffling arrangement for use in conjunction with an air-handling unit. One or more sound baffle columns are mounted for rolling or sliding movement within the interior of the air handling unit housing. Each baffle column may be selectively moved between a use position proximate to the fan assemblies, and a non-use position more distal from the fan assemblies. The movable sound baffles permit the air-handling unit to be fabricated to fit within a smaller housing, and thus to have a smaller, more economical footprint.

4 Claims, 6 Drawing Sheets

MOVABLE BAFFLE COLUMNS FOR USE WITH AIR HANDLING UNITS

BACKGROUND OF THE INVENTION

1. Field of the Invention (Technical Field)

The present invention relates to air handling units, such as which move large volumes of air with motor-driven fans, and relates particularly to sound-attenuation components for such units, and specifically to movable sound attenuating baffles for air handling units.

2. Background Art

Custom air handling units (AHU) are mechanical equipment that deliver tempered and/or filtered air (via ductwork) to a building or portions of its interior space. FIGS. 5 and 7 of the drawing figures depict the general layout of an air handling unit conventional to the art. Because the one or more fans 20 contained within the AHU to move the air can be quite noisy, it is common to install a bank of passive sound-attenuating baffles 10 between the fan(s) 20 and the intake or discharge port (or both) of the AHU as needed. The baffles 10 may either be self-supporting members arranged parallel to each other, or an array of modules that, like a filter bank, fill the interior cross-section of the AHU's airflow-conveying tunnel. Each baffle 10 has a rectangular, flat-oval or teardrop-shaped chord profile of some thickness, and the baffles are positioned so that the spacing between them is a predetermined distance. The sound attenuating performance of these baffles 10 depends on this distance or "passage width", the baffle thickness, the baffle length and its materials.

Typically, an individual baffle is composed of acoustically absorbing glass fiber batting fill, surrounded by a perimeter flow-facing skin of perforated metal that conforms to the desired chord profile and protects the fill. To separate the fill from the gas flow, without unduly impeding the transmission of sound from the flow into the acoustically absorbent media, an additional impermeable thin film sometimes is placed between the glass fiber and the perforated metal. Like filter banks, heat transfer coils, and other common components installed serially within the AHU air tunnel, these baffles or "sound traps" are—with respect to an AHU operating normally—permanent, immobile fixtures that occupy a fraction of the AHU's footprint.

In the marketplace for heating, ventilation and air-conditioning (HVAC) systems where such custom AHUs are engineered and sold, the size of an AHU's footprint can have a direct impact on its cost and likelihood of being selected. Hence, the smaller the footprint, the more competitive (from a commercial standpoint) a custom AHU becomes.

An AHU footprint is occupied by the physical lengths of the components and clearances reserved to enable access for component inspection, service and removal. For instance, one will usually find, at a minimum, a two-foot-long clear section upstream of a filter bank. This allows maintenance personnel to access individual filter modules and, if needed, replace dirty ones with clean modules.

In the case of sound traps positioned immediately downstream of a belt-driven fan 20, it is customary to reserve approximately two feet (or more) of AHU length between the belt-drive assembly and the intake side of the sound trap including the baffles 10 (FIG. 7) This permits convenient walking clearance around the fan-drive assembly 20. On the downstream side of the sound traps, there is usually a clearance of two or more feet to allow efficient diffusion of airflow discharging from the passages between parallel baffle surfaces. Without this downstream clearance during AHU operation, the aerodynamic resistance of the sound traps (and that of serially adjacent airflow-conveying components) tends to increase. Thus, industry practice maintains this clearance downstream of sound traps within an AHU.

But because the downstream clearance only impacts AHU performance when it operates, such a clearance is not required when the AHU is off and undergoing inspection or maintenance. This space can be used alternatively, as described herein.

SUMMARY OF THE INVENTION

Movable baffle columns for use in conjunction with an air-handling unit. One or more baffle columns are mounted for rolling or sliding movement within the interior of the air handling unit housing. Each baffle column may be selectively moved between a use position proximate to a fan assembly, and a non-use position more distal from a fan assembly. The movable baffles permit the air-handling unit to be fabricated to fit within a smaller housing, and thus to have a smaller, more economical footprint.

BRIEF DESCRIPTION OF THE DRAWINGS

The accompanying drawings, which are incorporated into and form a part of this specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Best Modes for Carrying Out the Invention

The present disclosure is of an AHU apparatus having a reduced footprint without compromising AHU performance.

By installing self-supporting sound-attenuating baffles on tracks, with complementary rollers or other means that permit translational movement, the presently disclosed apparatus permits the creation of temporary clearances that maintenance personnel need when an AHU is not operating. After maintenance completes its inspection and/or service, the baffles are returned to original, functional, positions prior to re-actuating the AHU.

A conventional wisdom that may have prevented the apparatus of the present disclosure from appearing in known AHU systems is that access sections between AHU components are considered to doubly function as regions where airflow can mix, concentrate or diffuse as the design intends. But these airflow considerations are relevant only when the AHU is in operation; so, the present apparatus exploits the fact that internal component layout can be more compact or otherwise assume a different configuration when the AHU is turned off (for maintenance or the like).

Figure 1:
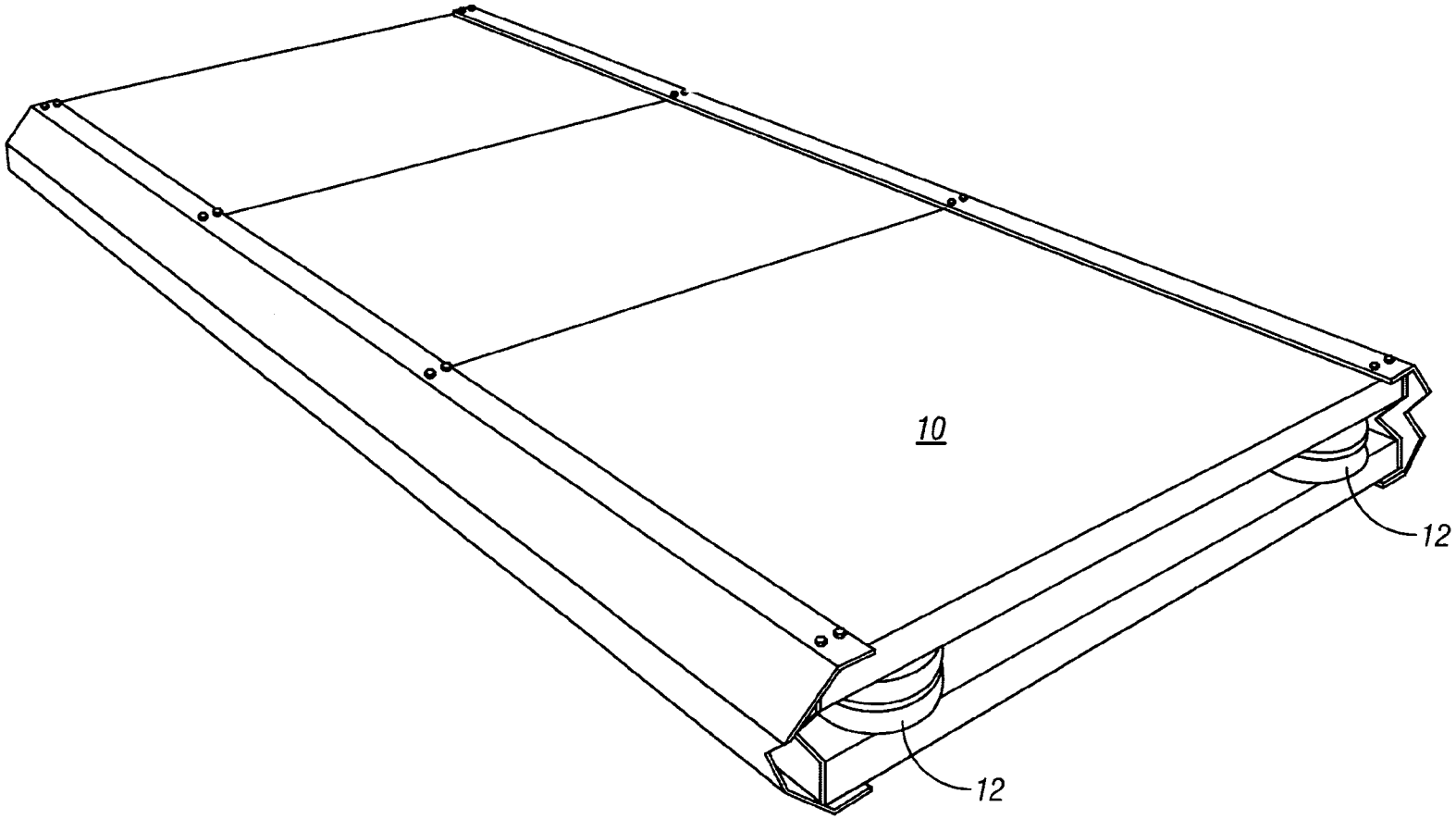
FIG. 1 is a perspective view of a column baffle according to the present disclosure, shown positioned horizontally (uninstalled) to show its bottom.
Figure 2:
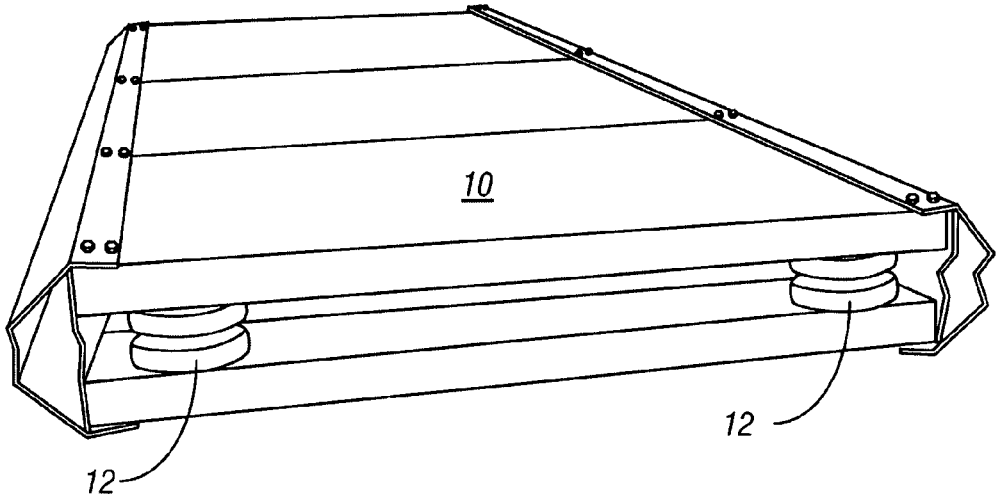
FIG. 2 is a perspective view of the bottom of the baffle column seen in FIG. 1, showing a pair of rollers.

Attention is invited to FIGS. 1 and 2, which depict the bottom of a baffle column 10 according to this disclosure. The baffle column 10 may be a closed plenum assembled from metal sheets. The bottom of each column is provided with at least two rollers 12, 12'. In the depicted embodiment, the two rollers 12, 12' are rotatably mounted near the front and rear edges of the column 10 respectively. Each roller preferably may be fabricated from a rigid durable plastic, although rollers made from metal alloy or other materials may be suitable. Each roller has lubricated or ball-bearing contact with its axle, so that the roller freely rotates about a horizontal axis when the baffle column 10 is vertically oriented for use. In the embodiment depicted, each roller has a circumferential groove (i.e., the roller is configured like a pulley wheel) which is engageable with a floor track upon which the baffle column rolls.

Figure 3:
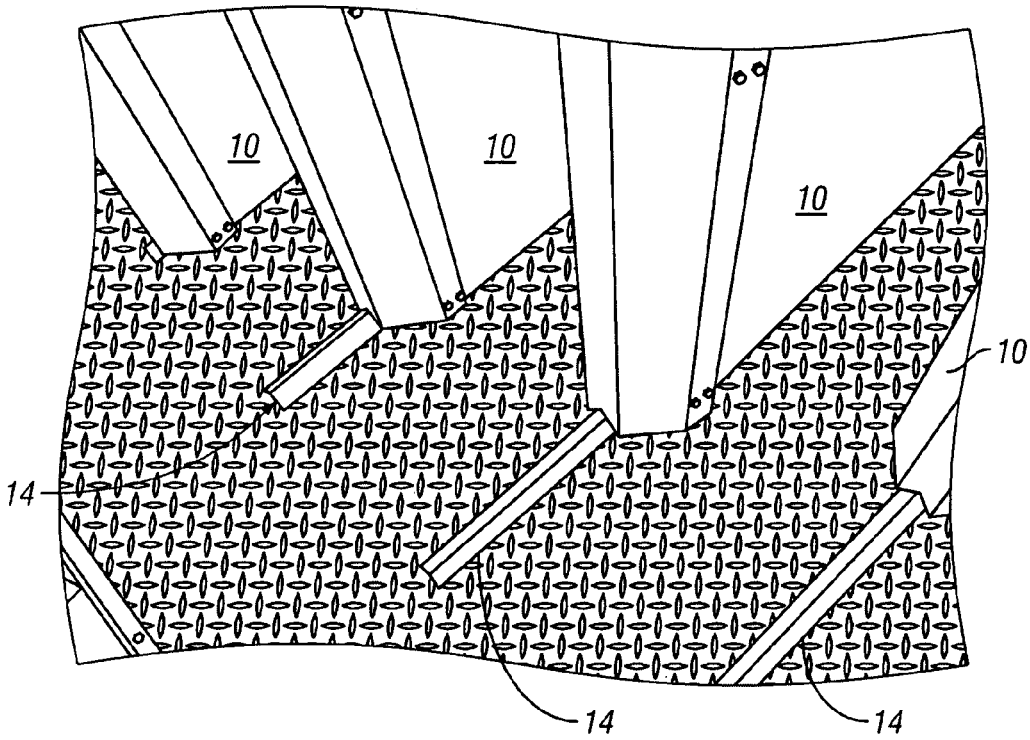
FIG. 3 is a partial perspective view, from above, of a portion of an apparatus according to the present disclosure, showing the bottom front edges of four baffle columns, disposed upon correspond tracks secured to the floor of an air handling unit.
Figure 4:
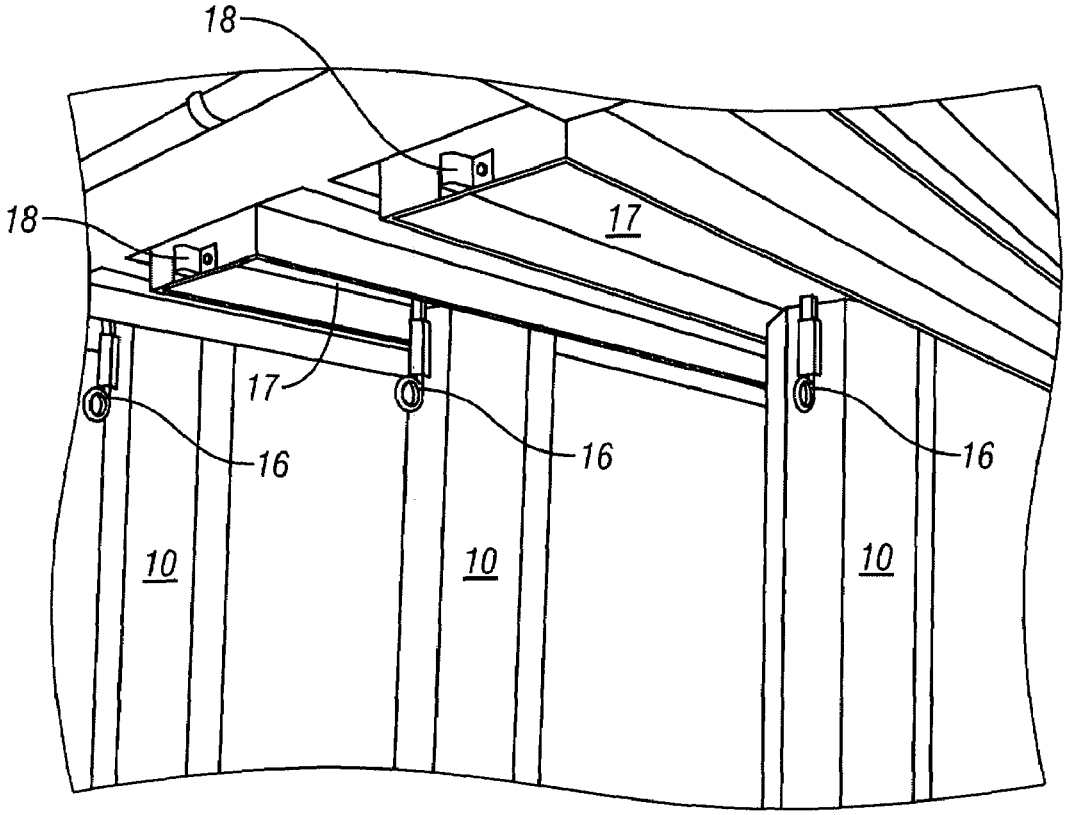
FIG. 4 is a partial perspective of the top front edges of three baffle columns, of a portion of an apparatus of this disclosure, showing the tops of the baffle columns slidably engaged with guide channels defined on the ceiling of an air handling unit housing.

FIGS. 3 and 4 show four baffle columns 10 installed for use. The columns are disposed vertically. As seen in FIG. 3, longitudinal tracks 14 are secured to the interior floor panel of the AHU, and serve to guide the movement of the baffle columns 10. A track 14 has a convex (e.g. a peaked inverted "V") profile complementary to the concave profile of the peripheries of the rollers, so that the rollers engage the tracks and roll along them. The engagement of the rollers with a track prevents the baffle column from moving in any direction except parallel to the track. Thus, each baffle column can roll to and fro within an imaginary vertical plane containing the corresponding track. The number of tracks corresponds to the number of baffle columns to be deployed, and the tracks ordinarily are disposed mutually parallel, so that adjacent baffle columns move in parallel planes. Further, each track 14 is longer than the length of its associated column. The extra length of a track 14, relative to its column 10, is approximately equal to the distance the baffle column rollably translates between its "use" and "non-use" positions.

It will be apparent to one skilled in the art that instead of convexly configured tracks and complementary concavely configured rollers, the apparatus may feature rollers having convex peripheries, engageable into concave groove-tracks defined on or in the floor.

FIG. 4 shows the tops of three baffle columns installed for use. The ceiling panel of the AHU is provided with parallel channels 17 of any suitable construction, to support and guide the top of each baffle column 10. In the depicted embodiment, the channels 17 are fashioned from metal flanges secured to the AHU ceiling; pairs of flanges are spaced apart a distance corresponding to the lateral thickness of the top of a baffle column. The channels 17 maintain the tops portions of the baffle columns 10 in parallel and properly spaced relation, and hold the columns against any lateral shifting. Each channel preferably has a smooth, flush, contact with both sides of the column; contact between channel and column is a sliding contact, aided by suitable lubrication as needed.

Each channel 17 is longer than the length of its associated column 10. The extra length of the channel 17, relative to its baffle 10, is approximately equal to the distance the baffle column rollably translates between its "use" and "non-use" positions.

It will be apparent to one skilled in the art that instead of concave configured channels in the ceiling which receive the tops of the baffle columns 10, the apparatus may feature convex ceiling tracks that engage into grooves along the tops of the baffle columns.

Continued reference to FIG. 4 shows how the front edge and the rear edge of each column 10 are provided each at its top with a sliding pin latch 16. Each pin latch 16 is selectively slidable up and down (along a generally vertical line), so to engage or disengage with a corresponding latch socket 18 in the ceiling of the AHU. In the depicted embodiment, the latch socket 18 is defined in the channel, as by the simple expedient of attaching a metal loop onto the short flange defining the end of the ceiling channel 17. Other suitable socket means are apparent and may be used. The latch pins 16 are used to releasably lock the baffle column 10 in position at either extreme of its travel along the tracks 14 (that is, at either the "front" end or the "back" end of the tracks and channels). Thus, each baffle column 10 can be releasably locked in its "use" position or in its "non-use" position by sliding the latch pin 16 into the appropriate latch socket 18. Of course, other means for releasably locking a baffle column in use or non-use position may be used.

Thus, the depicted embodiment utilizes eyelet bolts or similar hardware to manually temporarily fix each column 10 to any of one, two (or more, such as incremental) specific positions along the track 14. Other embodiments might employ motors or actuators to enable individual or multiple baffle translation and position fix (or even lock) via some form of remote control. For instance, a maintenance worker might activate a switch on a box outside the AHU that tells these actuators to move the columns 10 to the non-use "access" position instead of the "use" or "operating" position, and to lock them position.

Figure 7:
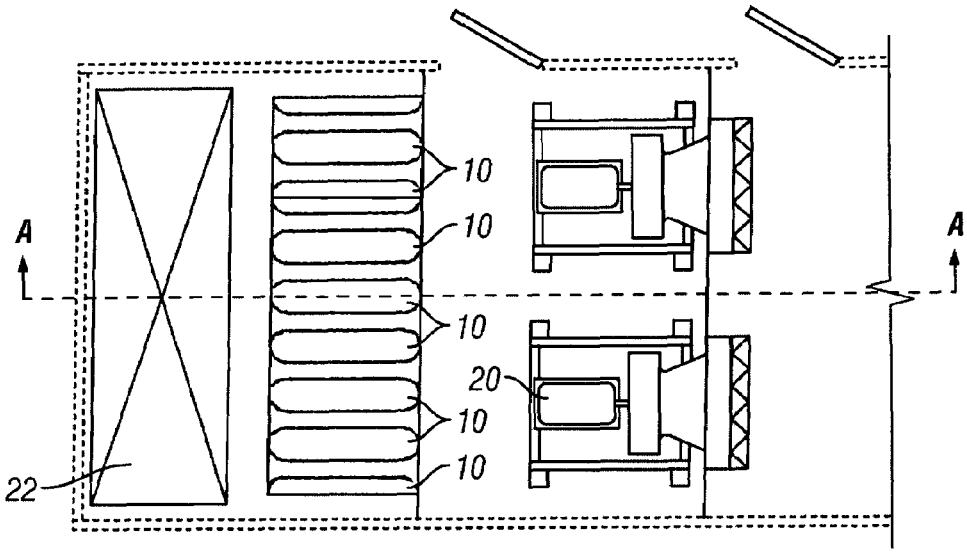
FIG. 7 (Prior Art)
FIG. 7 is a top plan view of an air handling unit known in the prior art, with a plurality of immobile baffle columns.
Figure 8:
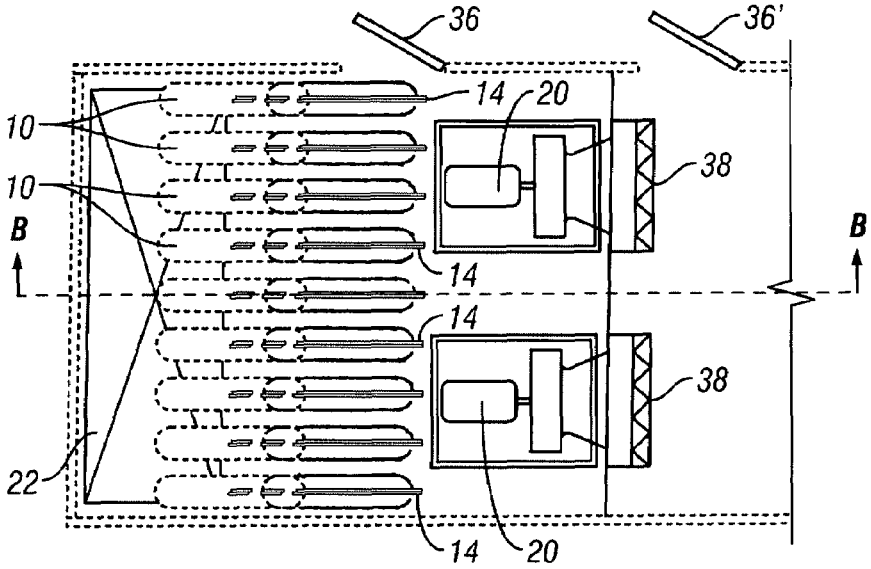
FIG. 8 is a top plan view of an air handling unit according to the present disclosure, showing a plurality of baffle columns independently movable along associated floor tracks, shown by solid lines in a non-use position, their use position being depicted in phantom lines.

From a visual comparison of the two plan views of a sample AHU in FIGS. 7 and 8, this method (FIG. 8) of baffle installation is superior to fixed and immobile installations of prior art (FIG. 7), in that it creates an opportunity for reducing or even eliminating what would otherwise be a typical access section. The benefit results from the decreased overall AHU footprint, which should reduce fabrication cost when compared to a functionally equivalent but slightly longer AHU with the conventional layout of components and associated clearances or access sections.

As explained, the means of providing this translational movement described in this embodiment employ v-grooved casters 12 on the top and bottom ends of each baffle 10. These casters 12 ride an angle-shaped track 14 for smooth movement. Surrounding the possible pathways that the baffle ends travel is a short solid metal barrier, which helps reduce the opportunity for gas flow, and the fan sound it conveys, to bypass the intended passages between the parallel baffles. While the baffles are often identical in chord profile and parallel with respect to one another, the chord profile of each could be different from its neighbor, and the actual passage bounded by baffle surfaces and "seen" by the traversing gas flow could be non-parallel (e.g., the adjacent baffle surfaces form a gradually diffusing evase shape described by some included angle).

Figure 5:
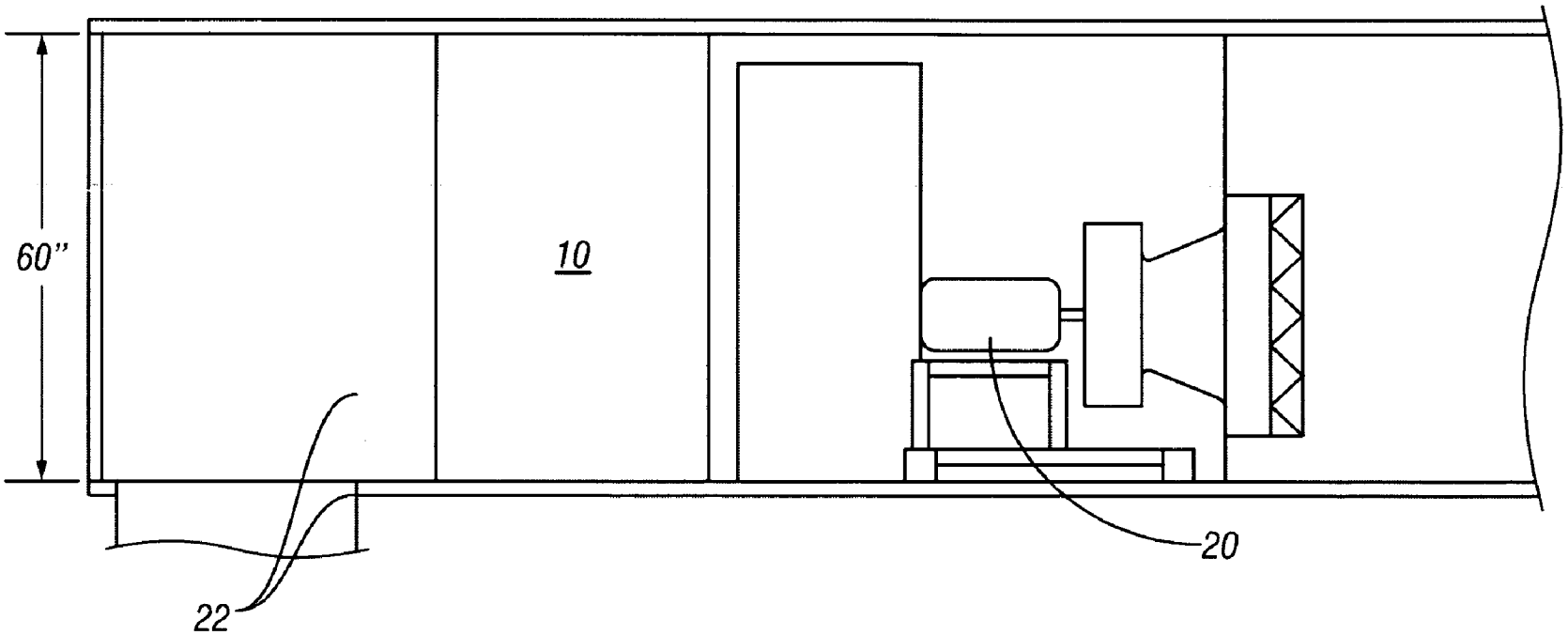
FIG. 5 (PRIOR ART)
FIG. 5 is a side sectional view, taken along line A-A in FIG. 7, of an air handling unit known in the art, depicting an immobile baffle column.

Referring to FIGS. 5 and 7, it is seen that the baffle columns 10 of a conventional AHU are fixed in location in relation to the other components of the AHU, including the fan assemblies 20 and a downstream feature such as a directional plenum 22 or a filter bank or the like. In known AHU configurations, the columns are stationary with a space of, say, twenty-six inches between the front or leading edges of the columns 10 and the rearmost portions of the fan assemblies 20. Similarly, access demands that there be a space of, for example, at least ten inches between the rear edges of the columns and the front of the downstream element 22.

Figure 6:
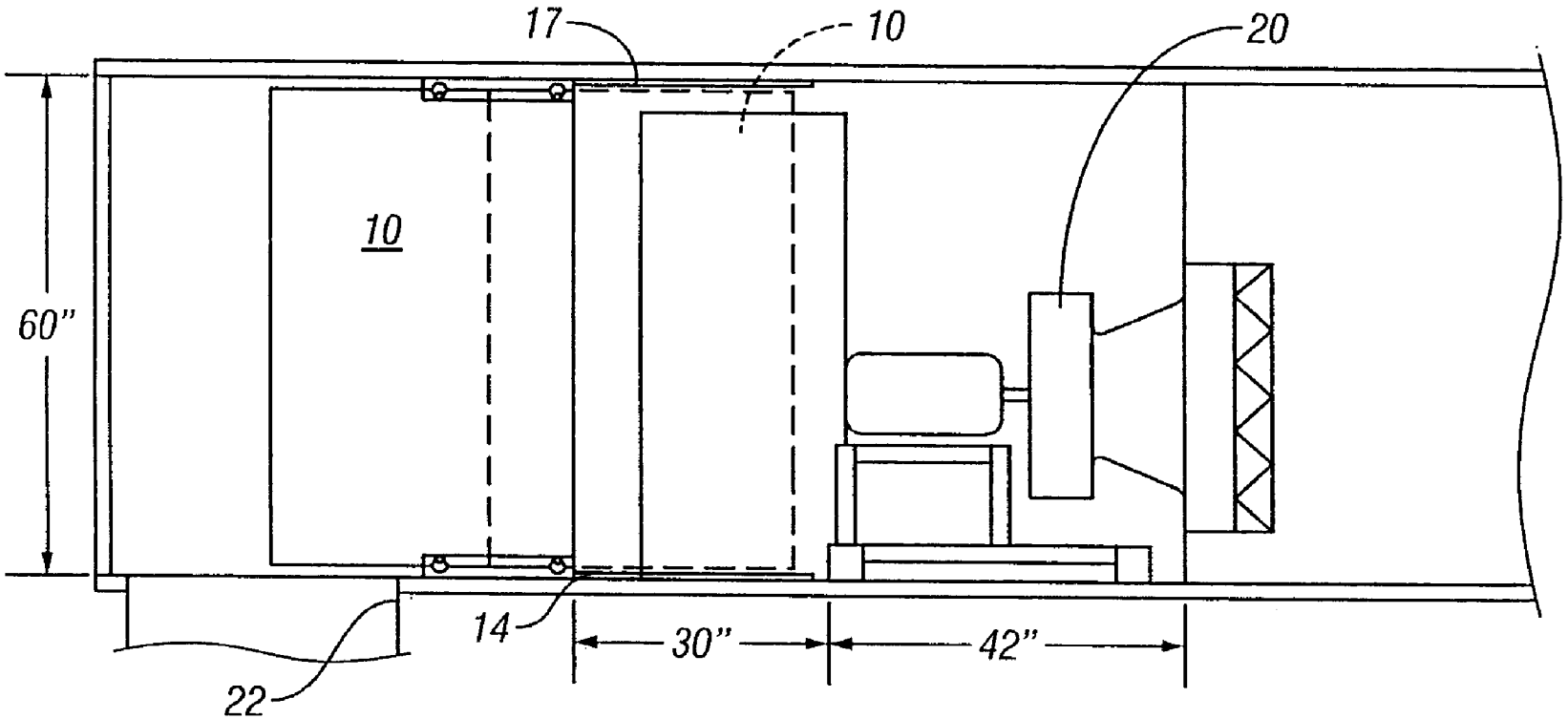
FIG. 6 is a is a side sectional view, taken along line B-B in FIG. 8, of an air handling unit according to the present disclosure, depicting a baffle column movable between a non-use maintenance position (shown by solid lines) and a use or operating position (shown in phantom lines)

FIGS. 6 and 8, however, illustrate that the baffle columns 10 of the present apparatus selectively moveable between a non-use or maintenance position and a "use" or operating position. In FIGS. 6 and 8, the baffles 10 in the maintenance position are shown in solid lines, while phantom lines show them in the use or operation position. In the operation position (phantom lines), the baffle columns 10 are temporarily but securely situated with their front or leading edges substantially proximate to the fan assemblies 20, with little space (e.g., six to twelve inches) separating the baffles 10 from the fan assemblies 20. However, when the necessity to access AHU interior components arises, the latch mechanisms 16,18 holding the baffles 10 in the operating position are disengaged or released; each baffle column 10 can then be rolled or slipped rearward along its respective track 14, toward the downstream end of the AHU (e.g., toward the discharge plenum 22). Such translational shifting may be continued until a baffle 10 obtains its rearward-most position along its respective track 14, and thus is in the non-use maintenance position (as depicted by the solid-line baffles in the drawing figures). In the maintenance position, each baffle 10 is spaced a distance of, for example, 30 inches from the fan assemblies 20. Each baffle column that has been relocated to its maintenance position can be reliably locked into that position by engaging lock latches 16, 18 as described previously herein;

As seen in FIGS. 6 and 8, after all the baffles have been moved to their maintenance positions, there is provided ample access space between the front edges of the baffles and the rear portions of the fan assemblies. In the non-use maintenance position, the baffles 10 extend into, or overlap with, or extend over, a downstream element 22; however, such positioning does not interfere with the function of the AHU, since the baffle columns are returned to their operating positions before the AHU is restored to service and actuated. When releasably locked in their operating positions (again, as represented by the phantom lines in the figures), the baffles 10 are spaced forward from the downstream plenum or other element 22 an adequate distance to permit service personnel to pass safely between the baffles and the downstream element 22 as needed. Access doors 36, 36' may be provided in the AHU housing to permit personnel access to the AHU interior, as needed, but then closed when the AHU is in operation. A forward door 36' offers ready access to the upstream or intake plenum 38 to the fan assemblies 20 (FIG. 8).

It is immediately understood that as a result of having longitudinally movable baffle columns 10 that can be selectively shifted between maintenance and operating positions, the overall footprint length of the AHU can be shortened. A comparison of FIGS. 7 and 8 shows that the length of the AHU can be shortened, in this disclosed embodiment, by a distance (e.g., twenty-four inches) approximating the distance of to-and-fro movement of the columns 10.

Although the afore-described apparatus relates to a sound trap bank, it likewise could relate to a filter bank or some other AHU component that could be moved with the AHU otherwise intact and the fans inoperative. For example, filter banks could be another application for this means of translational movement: in general, filters are even lighter (in weight) than sound attenuating baffles. Heat transfer coils, in contrast, likely could not take ready advantage of the benefits of this apparatus, since their positions are fixed by piping connections to the building where the AHU is installed.

It is known for AHU components to be fabricated and/or installed so that they are removable with some level of mechanical effort. Even a heat transfer coil bank may feature piping connections and a rack that allows it slide laterally into or out of an AHU. But in the present apparatus and methodology, certain lightweight components, namely a sound trap, or possibly a filter or other components that do not require fixed positions when the AHU is inoperative (or do not have inflexible physical or electrical connections to systems external to the AHU), can resemble a movable shelf—whether such movement is manual or motorized—and yield similar space savings that enable a smaller AHU footprint and hence competitiveness.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all applications, patents, and publications cited above are hereby incorporated by reference.

What is claimed is:

1. An air-handling unit, comprising:

a housing;

at least one fan assembly for moving air through the housing in a direction toward a downstream feature;

at least one guidance track on a floor of the housing;

at least one baffle column upon the track, and selectively movable, along the track substantially parallel to the direction of moving air, between a use position proximate to the fan assembly and a non-use position more distal from the fan assembly.

2. An apparatus according to claim 1 wherein the at least one baffle column comprises a plurality of baffle columns disposed substantially mutually parallel and substantially parallel to the direction of the moving air.

3. An apparatus according to claim 1 wherein the at least one baffle column comprises a sound-attenuating plenum.

4. An apparatus according to claim 1 wherein the at least one baffle column comprises an air filter.

* * * * *